US006926790B2

(12) United States Patent
Weed

(10) Patent No.: US 6,926,790 B2
(45) Date of Patent: Aug. 9, 2005

(54) OVERCOATED DONOR ELEMENTS AND THEIR PROCESS OF USE

(75) Inventor: Gregory C. Weed, Towanda, PA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 50 days.

(21) Appl. No.: 10/257,485

(22) PCT Filed: May 9, 2001

(86) PCT No.: PCT/US01/14874

§ 371 (c)(1),
(2), (4) Date: Oct. 11, 2002

(87) PCT Pub. No.: WO01/87635

PCT Pub. Date: Nov. 22, 2001

(65) Prior Publication Data

US 2003/0175452 A1 Sep. 18, 2003

Related U.S. Application Data

(60) Provisional application No. 60/204,922, filed on May 17, 2000.

(51) Int. Cl.[7] ..... B41M 5/40

(52) U.S. Cl. ..... 156/235; 428/32.77; 428/32.78; 428/32.79; 428/32.83; 430/945; 503/227

(58) Field of Search ..... 156/235; 428/32.77, 428/32.78, 32.79, 32.83; 430/945; 503/227

(56) References Cited

U.S. PATENT DOCUMENTS

| | | | |
|---|---|---|---|
| 4,643,917 | A | 2/1987 | Koshizuka et al. |
| 4,792,495 | A | 12/1988 | Taniguchi et al. |
| 4,942,141 | A | 7/1990 | DeBoer et al. |
| 4,948,776 | A | 8/1990 | Evans et al. |
| 5,019,549 | A | 5/1991 | Kellogg et al. |
| 5,045,383 | A | 9/1991 | Maeda et al. |
| 5,156,938 | A | 10/1992 | Foley et al. |
| 5,171,650 | A | 12/1992 | Ellis et al. |
| 6,358,597 | B1 | 3/2002 | Krauter |

FOREIGN PATENT DOCUMENTS

| | | |
|---|---|---|
| EP | 0381297 | 8/1990 |
| EP | 0955183 A2 | 5/1998 |

*Primary Examiner*—Bruce Hess
(74) *Attorney, Agent, or Firm*—Thomas H. Magee

(57) ABSTRACT

A donor element is described for use in a thermal imaging process. The donor element includes a support: a heating layer; a colorant containing transfer layer; and an overcoat layer comprising a wax having a melting point ranging from about 30° C. to about 350° C. Typically the wax is a natural vegetable wax, a mineral wax or a synthetic wax.

16 Claims, 2 Drawing Sheets

OVERCOATED DONOR ELEMENTS AND THEIR PROCESS OF USE

CROSS-REFERENCE TO RELATED APPLICATION

This application claims the benefit of U.S. Provisional Application No. 60/204,922 filed May 17, 2000 which is incorporated herein by reference in its entirety.

FIELD OF THE INVENTION

This invention relates to improved processes and products for effecting laser-induced thermal transfer imaging using overcoated donor elements.

BACKGROUND OF THE INVENTION

Laser-induced thermal transfer processes are well-known in applications such as color proofing and lithography. Such laser-induced processes include, for example, dye sublimation, dye transfer, melt transfer, and ablative material transfer. These processes have been described in, for example, Baldock:, U.K. Patent 2,083,726; DeBoer, U.S. Pat. No. 4,942,141; Kellogg, U.S. Pat. No. 5,019,549; Evans, U.S. Pat. No. 4,948,776; Foley et al., U.S. Pat. No. 5,156,938; Ellis et al., U.S. Pat. No. 5,171,650; and Koshizuka et al., U.S. Pat. No. 4,643,917.

Laser-induced processes use a laserable assemblage comprising (a) a donor element that contains a thermally imageable coating in contact with a receiver element. The laserable assemblage is imagewise exposed by a laser, usually an infrared laser, resulting in transfer of exposed areas of the thermally imageable coating, also referred to as material, from the donor element to the receiver element. The (imagewise) exposure takes place only in a small, selected region of the laserable assemblage at one time, so that transfer of material from the donor element to the receiver element can be built up one pixel at a time. Computer control produces transfer with high resolution and at high speed. The laserable assemblage, upon imagewise exposure to a laser as described supra, is henceforth termed an imaged laserable assemblage.

Known donor elements tend to lack high durability; that is, they can be scratched, tend to block and can inadvertently adhere to many surfaces. Defects resulting from the lack of durability can transfer to the final image resulting in an unacceptable appearance.

Consequently, a need exists for an improved donor element that has improved surface properties such as durability, antiblocking, rub and mar resistance, adhesion and water and humidity resistance.

IR absorbers which are used to facilitate image transfer have been found to negatively impact color purity when added to the thermally imageable layer of the donor element. Thus, a need exists for an IR absorber layer in the donor element separate from the thermally imageable layer.

SUMMARY OF THE INVENTION

Improved products and processes for laser induced thermal imaging are disclosed herein.

In a first aspect, this invention relates to a donor element for use in a thermal imaging process comprising:

(a) a donor support;

(b) a thermally imageable coating; and (c) an overcoat layer comprising a wax having a melting point in the range of about 30° C. to about 350° C.

In the first aspect, this invention also relates to an overcoat layer further comprising an acrylic polymer.

In the first aspect, this invention also relates to an overcoat layer further comprising an IR absorber.

In a second aspect this invention relates to a method for making an image comprising:

(1) imagewise exposing to laser radiation a laserable assemblage comprising:

(A) the donor element comprising (a) a thermally imageable coating having a coatable surface, and (b) an overcoat layer on the coatable surface of the thermally imageable coating comprising a wax having a melting point in the range of about 30° C. to about 350° C.; and (B) a receiver element in contact with the overcoat layer of the donor element, the receiver element comprising:

(a) an image receiving layer; and (b) a receiver support;

whereby the exposed areas of the thermally imageable coating and overcoat layer are transferred to the receiver element to form an image on the image receiving layer; and (2) separating the donor element (A) from the receiver element (B), thereby revealing the image on the image receiving layer of the receiver element.

This so revealed image may then be transferred to a permanent substrate by contacting the receiver element with the permanent substrate, with the image receiving layer bearing the revealed image adjacent the permanent substrate.

In the second aspect, the invention also relates to a method further comprising, after step (2):

(3) contacting the image on the image receiving layer of the receiver element with an image rigidification element comprising:

(a) a support, and (b) a thermoplastic polymer layer releaseably applied to the support, the image being adjacent the thermoplastic polymer layer during said contacting, whereby the image is encased between the thermoplastic polymer layer and the image receiving layer of the receiving element;

(4) removing the support thereby revealing the thermoplastic polymer layer; and (5) contacting the revealed thermoplastic polymer layer from step (4) with a permanent substrate.

Typically, the donor element is formed by applying a thermally imageable-coating, usually comprising a colorant, to a base element, followed by application of the overcoat layer.

In the second aspect, this invention relates to a method for making a color image, further comprising after step (5):

(6) removing the receiver support.

DETAILED DESCRIPTION OF THE INVENTION

Processes and products for laser induced thermal transfer imaging are disclosed wherein the donor element has durability, resistance to blocking, rubs and mars, adhesion, water and humidity. The donor element of this invention also produces imaged products with better color purity because the IR absorber is in an overcoat layer of the donor element.

Donor Element

The donor element comprises a support, a thermally imageable coating, and an overcoat layer.

Optional additional layers such as a heating layer or an intermediate layer selected from the group consisting of a subbing layer or an ejection layer or both may also be present.

Figure 1:
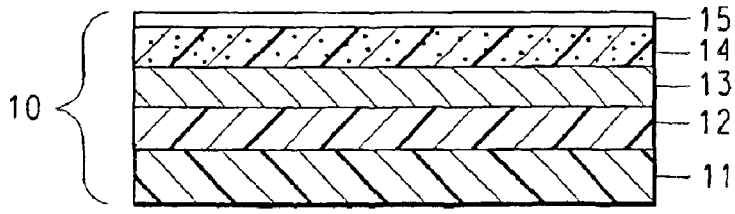
FIG. 1 is a simplified schematic diagram showing a cross-section of a donor element.

An example of a suitable donor element is shown in FIG. 1. The donor element comprises an overcoat layer (15), and a thermally imageable layer (14) which is prepared from a thermally imageable coating typically comprising a colorant. Optionally, the donor element comprises an intermediate layer (12), a heating layer (13), and a donor support (11). Typically, the heating layer (13) is located directly on the support (11).

Typically, the donor support is a thick (400 guage) coextruded polyethylene terephthalate film. Alternately, the donor support is a polyester film, specifically polyethylene terephthalate that has usually been plasma treated to accept the heating layer. When the donor support is plasma treated, an intermediate layer is usually not provided on the donor support. Backing layers may optionally be provided on the side of the donor support opposite the side of the support with the thermally imageable coating. These backing layers may contain fillers to provide a roughened surface on the back side of the donor support. Alternately, the donor support itself may contain fillers, such as silica, to provide a roughened surface on the back surface of the support.

The optional intermediate layer (12), as shown in FIG. 1, is the layer that may provide additional force to effect transfer of the thermally imageable coating to the receiver element in the exposed areas.

If the laserable assemblage is imaged through the intermediate layer, the intermediate layer should be capable of transmitting the laser radiation, and not be adversely affected by this radiation.

The intermediate layer may be an ejection layer which, when heated, decomposes into gaseous molecules providing the necessary pressure to propel or eject the exposed areas of the thermally imageable coating onto the receiver element. This is accomplished by using a polymer having a relatively low decomposition temperature (less than about 350° C., preferably less than about 325° C., and more preferably less than about 280° C.). In the case of polymers having more than one decomposition temperature, the first decomposition temperature should be lower than about 350° C. In a typical embodiment, the ejection layer is flexible. In order for the ejection layer to have suitably high flexibility and conformability, it should have a tensile modulus that is less than or equal to about 2.5 Gigapascals (GPa), preferably less than about 1.5 GPa, and more preferably less than about 1 GPa. It has been found beneficial if the polymer chosen is dimensionally stable.

When the intermediate layer functions as an ejection layer, examples of suitable polymers include (a) polycarbonates having low decomposition temperatures (Td), such as polypropylene carbonate; (b) substituted styrene polymers having low decomposition temperatures, such as poly (alpha-methylstyrene); (c) polyacrylate and polymethacrylate esters, such as polymethylmethacrylate and polybutylmethacrylate; (d) cellulosic materials having low decomposition temperatures (Td), such as cellulose acetate butyrate and nitrocellulose; and (e) other polymers such as polyvinyl chloride; poly(chlorovinyl chloride) polyacetals; polyvinylidene chloride; polyurethanes, with low Td; polyesters; polyorthoesters; acrylonitrile and substituted acrylonitrile polymers; maleic acid resins; and copolymers of the above. Mixtures of polymers can also be used. Additional examples of polymers having low decomposition temperatures can be found in Foley et al., U.S. Pat. No. 5,156,938. These include polymers which undergo acid-catalyzed decomposition. For these polymers, it is frequently desirable to include one or more hydrogen donors with the polymer.

Preferred polymers for the ejection layer are polyacrylate and polymethacrylate esters, low Td polycarbonates, nitrocellulose, poly(vinyl chloride) (PVC), and chlorinated poly(vinyl chloride) (CPVC). Most preferred are poly(vinyl chloride) and chlorinated poly(vinyl chloride).

Other materials can be present as additives in the intermediate layer as long as they do not interfere with the essential function of the layer. Examples of such additives include coating aids, flow additives, slip agents, antihalation agents, plasticizers, antistatic agents, surfactants, and others which are known to be used in the formulation of coatings.

The intermediate layer may also be a subbing layer (12) to provide a donor element having in order at least one subbing layer (12), optionally, a heating layer (13), and at least one thermally imageable coating(14) and an overcoat layer.

When the intermediate layer is a subbing layer, it is characterized by an ability to adhere to an adjacent layer of the donor element, such as the heating layer or the donor support. Examples of suitable materials for the subbing layer include polyurethanes, polyvinyl chloride, cellulosic materials, acrylate or methacrylate homopolymers and copolymers, and mixtures thereof. Other custom made decomposable polymers may also be useful in the subbing layer. Typically useful as subbing layers for polyester, specifically polyethylene terephthalate, are acrylic subbing layers. Typically, the subbing layer has a thickness of about 100 Angstroms to about 1000 Angstroms.

The optional heating layer (13) of the base element, as shown in FIG. 1, is usually deposited on the optional intermediate layer (12). More typically, the heating layer (13) is deposited directly on the support (11). The function of the heating layer is to absorb the laser radiation and convert the radiation into heat. Materials suitable for the heating layer can be inorganic or organic and can inherently absorb the laser radiation or include additional-laser-radiation absorbing compounds.

Examples of suitable inorganic materials are transition metal elements and metallic elements of Groups IIIA, IVA, VA, VIA, VIIIA, IIIB, and VB, their alloys with each other, and their alloys with the elements of Groups IA and IIA of the Periodic Table of the Elements in Lange's Handbook of Chemistry, $13^{th}$ edition, John A. Dean, 1985. Tungsten (W) is an example of a Group VIA metal that is suitable and which can be utilized. Carbon (a Group IVB nonmetallic element) can also be used. Preferred metals include Al, Cr, Sb, Ti, Bi, Zr, Ni, In, Zn, and their alloys and oxides; carbon is a preferred nonmetal. More preferred metals and nonmetals include Al, Ni, Cr, Zr and C. Most preferred metals are Al, Ni, Cr, and Zr. A useful metal oxide is $TiO_2$.

The thickness of the heating layer is generally about 20 Angstroms to about 0.1 micrometer, preferably about 40 to about 100 Angstroms.

Although it is preferred to have a single heating layer, it is also possible to have more than one heating layer, and the different layers can have the same or different compositions, as long as they all function as described above. The total thickness of all the heating layers should be in the range given above, i.e., about 20 Angstroms to about 0.1 micrometer.

The heating layer(s) can be applied using any of the well-known techniques for providing thin metal layers, such as sputtering, chemical vapor deposition, and electron beam.

The thermally imageable layer (14) of the donor element is formed by applying a binder composition on one side of the donor support. The thermally imageable layer may comprise a polymeric binder which is different from the polymer in the intermediate layer.

The binder for the thermally imageable coating is usually a polymeric material having a decomposition temperature that is greater than about 300° C. and preferably greater than about 350° C. The binder should be film forming from solution or from a dispersion. Binders having melting points less than about 250° C. or plasticized to such an extent that the glass transition temperature is less than about 70° C. are preferred. However, heat-fusible binders, such as waxes should be avoided as the sole binder since such binders may not be as durable, although they are useful as cobinders in decreasing the melting point of the top layer.

It is preferred that the binder does not self-oxidize, decompose or degrade at the temperature achieved during the laser exposure so that the exposed areas of the thermally imageable layer comprising a colorant and a binder, are transferred intact for improved durability. Examples of suitable binders comprise an acrylate, methacrylate, acrylonitrile, acrylic acid, methacrylic acid, $C_1$–$C_4$ olefin acrylate such as butyl acrylate, $C_1$–$C_4$ methacrylate such as methyl methacrylate or butyl methacrylate. Other suitable binders include copolymers of styrene and (meth)acrylate esters, such as styrene/methacrylate copolymer, styrene/methyl-methacrylate copolymer; copolymer of styrene and olefin monomers, typically containing about 1 to about 4 carbon atoms, such as styrene/ethylene/butylene; copolymers of styrene and acrylonitrile; fluoropolymers; copolymers of (meth)acrylate esters with ethylene and carbon monoxide; polycarbonates having decomposition temperatures higher than 300° C., typically 280 C.; (meth)acrylate homopolymers and copolymers; polysulfones; polyurethanes; polyesters. The monomers for the above polymers can be substituted or unsubstituted. Mixtures of polymers can also be used.

Typically polymers for the thermally imageable layer include, but are not limited to, acrylate homopolymers, copolymers and terpolymers; methacrylate homopolymers, copolymers and terpolymers; (meth)acrylate block copolymers; and (meth)acrylate copolymers containing other comonomers, such as acrylonitrile and styrene. Some specific examples include a copolymer of methyl methacrylate and butyl methacrylate and a terpolymer of butyl acrylate, acrylonitrile and methacrylic acid such as an acrylic latex copolymer of 74% methyl methacrylate and 24% butyl methacrylate, and a latex (47% solids) comprising a mixture of butyl acrylate/acrylonitrile/methacrylic acid copolymer (60/35/5).

A plasticizer may also be included which, typically is a low glass transition temperature polymer, that acts as a softener for the binder as may be needed when the polymer of the binder has a high glass transition temperature. An example of a suitable plasticizer is polyethylene glycol.

The binder is generally used in a concentration of about 15 to about 50% by weight, based on the total weight of the thermally imageable layer, typically about 30 to about 40% by weight based on the total weight of the thermally imageable layer.

When the thermally imageable layer imparts a color image, e.g. in color proofing or color filter manufacturing, the colorant of the thermally imageable layer can be a pigment or a dye, typically a non-sublimable dye. Typically pigments are used as the colorant for stability and for color density, and also for the high decomposition temperature. Examples of suitable inorganic pigments include carbon black and graphite. Examples of suitable organic pigments include Rubine F6B (C.I. No. Pigment 184); Cromophthal® Yellow 3G (C.I. No. Pigment Yellow 93); Hostaperm® Yellow 3G (C.I. No. Pigment Yellow 154); Monastral® Violet R (C.I. No. Pigment Violet 19); 2,9-dimethylquinacridone (C.I. No. Pigment Red 122); Indofast® Brilliant Scarlet R6300 (C.I. No. Pigment Red 123); Quindo Magenta RV 6803; Monastral® Blue G (C.I. No. Pigment Blue 15); Monastral® Blue BT 383D (C.I. No. Pigment Blue 15); Monastral® Blue G BT 284D (C.I. No. Pigment Blue 15); and Monastral® Green GT 751D (C.I. No. Pigment Green 7). Combinations of pigments and/or dyes can also be used. For color filter array applications, high transparency pigments (that is at least about 80% of light transmits through the pigment) are preferred, having small particle size (that is about 100 nanometers).

In some embodiments of this invention, a pigment, such as carbon black, is present in a single layer, termed the top layer. This type of pigment functions as both a heat absorber and a colorant, and thus the top layer has a dual function of being both a heating layer and a thermally imageable layer. The characteristics of the top layer are the same as those given for the thermally imageable layer. A preferred colorant/heat absorber is carbon black.

In accordance with principles well known to those skilled in the art, the concentration of colorant will be chosen to achieve the optical density desired in the final image. The amount of colorant will depend on the thickness of the active coating and the absorption of the colorant. Optical densities greater than 1.3 at the wavelength of maximum absorption are typically required. Even higher densities are preferred. Optical densities adequate for a particular application can be achievable with application of this invention.

A dispersant is usually present when the colorant is a pigment. The colorant dispersant may be the same or different from that used to disperse the immiscible compound. The colorant dispersant is generally an organic polymeric compound and is used to separate the fine pigment particles and avoid flocculation and agglomeration. A wide range of colorant dispersants are commercially available. A colorant dispersant will be selected according to the characteristics of the pigment surface and other components in the composition as practiced by those skilled in the art. However, one class of colorant dispersant suitable for practicing the invention is that of the AB dispersants. The A segment of the dispersant adsorbs onto the surface of the pigment. The B segment extends into the solvent into which the pigment is dispersed. The B segment provides a barrier between pigment particles to counteract the attractive forces of the particles, and thus to prevent agglomeration. The B segment should have good compatibility with the solvent used. The AB dispersants of choice are generally described in U.S. Pat. No. 5,085,698. Conventional pigment dispersing techniques, such as ball milling, sand milling, etc., can be employed.

The colorant is usually present in an amount of from about 25 to about 95% by weight, typically about 35 to about 65% by weight, based on the total weight of the thermally imageable layer.

The thermally imageable layer is usually applied by coating from a dispersion. Any suitable solvent can be used as a coating solvent, as long as it does not deleteriously affect the properties of the assemblage. The thermally imageable layer can be applied to the base element of the donor element using conventional coating techniques or printing techniques, for example, gravure printing. A preferred solvent is water. A thermally imageable layer may be applied by a Waterproof® Color Versatility Coater sold by DuPont, Wilmington, Del. Coating of the thermally imageable layer can thus be done shortly before the exposure step. This also allows for the mixing of various basic colors together to fabricate a wide variety of colors to match the Pantene® color guide currently used as one of the standards in the proofing industry.

The thermally imageable layer generally has a thickness in the range of about 0.1 to about 5 micrometers, preferably in the range of about 0.1 to about 1.5 micrometers. Thickness greater than about 5 micrometers are generally not preferred as they require excessive energy in order to be effectively transferred to the receiver.

Although it is preferred to have a single thermally imageable layer, it is also possible to have more than one thermally imageable layer, and the different layers can have the same or different compositions, as long as they all function as described above. The total thickness of the combined thermally imageable layers should be in the range given above.

Other materials can be present as additives in the thermally imageable layer as long as they do not interfere with the essential function of the-layer. Examples of such additives include layer aids, plasticizers, flow additives, slip agents, antihalation agents, antistatic agents, surfactants, and others which are known to be used in the formulation of coatings. However, it is preferred to minimize the amount of additional materials in this layer, as they may deleteriously affect the final product after transfer. Additives may add unwanted color for color proofing applications, or they may decrease durability and print life in lithographic printing applications.

The overcoat layer (15), as shown in FIG. 1, provides surface properties of durability, resistance to blocking, lubs, mars, adhesion, water and humidity. This layer comprises a wax having a melting point in the range of about 30° C. to about 350° C., typically about 45° C. to about 300° C. The wax may be selected from both natural and synthetic waxes. Usually, the natural wax consists of any vegetable wax having a melting point (mp.) in the range of about 80° C. to about 88° C., such as carnauba (mp 83–86° C.); any mineral wax having a melting point in the range of about 45° C. to about 100° C., such as paraffin (highly refined petroleum, mp 48° C.–74° C.), montan (from lignite, mp 79° C.–89° C.), and microcrystalline (high MW petroleum distillate, mp 73° C.–94° C.); synthetic wax having a melting point in the range of about 30° C. to about 350° C., typically about 85° C. to 150° C., such as Fischer-Tropsch wax (from coal gasification, mp approx. 99° C.), polyolefin glycol (mp solids from room temperature to approximately 65° C.), high density polyethylene (mp 85–141° C.), low density polyethylene, (mp 30–141° C.), polyethyleneacrylic acid (mp 75–80° C.), polypropylene (mp 135–160° C.), polytetraflouroethylene (mp 320° C.). Some useful synthetic wax come in an oxidized form such as oxidized high density polyethylene. Typically, these waxes are solid at ambient temperature.

Specific commercial waxes that are supplied either as neat solids or in aqueous emulsions or dispersions are oxidized high density polyethylene waxes such as A-C waxes from Allied Signal ; polyolefin wax such as Epolene® from Eastman Chemical; ethylene acrylic acid wax such as Primacor® from Dow Chemical; polyolefin glycol wax such as Carbowax® from Union Carbide and Pluracol® from BASF ; stearate wax; amide wax; petrolatum wax such as paraffin wax and microcrystalline; silicone wax; mineral wax such as montan wax, polypropylene wax; carnauba wax; and fluorocarbon wax such as polytetrafluoro ethylene wax all supplied by Michelman. Inc. under the trade name Michem®. A specific example of a useful wax is Zinpol200 which is an aqueous polyethylene wax.

Typically, the wax may be present in the amount of about 3% to about 100% by weight, more typically in the amount of about 30% to about 70% by weight, based on the total weight of the overcoat layer.

Optionally, this overcoat layer may contain acrylic and methacrylic polymers. A suitable acrylic polymer includes Carboset® GA-33 from B. F. Goodrich. Typically, the acrylic polymer is present in the amount of about 5 to about 97% by weight, more typically in the amount of about 30% to about 70% by weight, based on the total weight of the layer.

Other additives may be present in the layer imparting roughening or texture to improve film handling and image quality. Some suitable additives include inorganic fillers such as silica and alumina. Other additives may be present in the layer to improve image transfer such as a thermal amplification additive such as an NIR absorber. Typical examples include a cyanine dye or carbon black.

An overcoat layer comprising a wax permits a textured surface to be imparted to the donor element. Textured overcoat layers may be achieved by any method known in the art but use of a wax coating material which contains wax particles of a size greater than the overall thickness of the was overcoat layer, typically at least about 0.1 microns in size and more typically about 0.2 to about 1 micron in size, will result in the overcoat layer having a texture.

The above identified overcoat layer provide a vehicle for the introduction of the thermal amplification additive. A thermal amplification additive may also optionally be present in the ejection layer(s), subbing layer or the thermally imageable layer. It can also be present in all of these layers.

The function of the additive is to amplify the effect of the heat generated in the heating layer and thus to further increase sensitivity. The additive should be stable at room temperature. The additive can be (1) a compound which, when heated, decomposes to form gaseous byproducts(s), (2) a dye which absorbs the incident laser radiation, or (3) a compound which undergoes a thermally induced unimolecular rearrangement which is exothermic. Combinations of these types of additives may also be used.

Thermal amplification additives which decompose upon heating include those which decompose to form nitrogen, such as diazo alkyls, diazonium salts, and azido (—N3) compounds; ammonium salts; oxides which decompose to form oxygen; carbonates; peroxides. Mixtures of additives can also be used. Preferred thermal amplification additives of this type are diazo compounds such as 4-diazo-N,N' diethyl-aniline fluoroborate (DAFB).

When the thermal amplification additive is a dye whose function is to absorb the incident radiation and convert this into heat, leading to more efficient heating for image transfer. It is preferred that the dye absorb in the infrared region. For imaging applications, it is also preferred that the dye have very low absorption in the visible region. Examples of suitable NIR (near infrared absorbing) dyes which can be used alone or in combination include poly(substituted) phthalocyanine compounds and metal-containing phthalocyanine compounds; cyanine dyes; squarylium dyes; chalcogenopyryioacrylidene dyes; croconiunm dyes; metal thiolate dyes; bis(chalcogenopyrylo) polymethine dyes; oxyindolizine dyes; bis(aminoaryl) polymethine dyes; merocyanine dyes; and quinoid dyes.

Infrared absorbing materials disclosed in U.S. Pat. Nos. 4,778,128; 4,942,141; 4,948,778; 4,950,639; 5,019,549; 4,948,776; 4,948,777; 4,952,552, 5,550,884; 5,440,042; 5,932,740; 5,777,127; 5,576,443 and 5,440,042 may also be suitable herein. The weight percentage of the thermal amplification additive, versus, for example, the total solid weight composition of the layer, e.g. the overcoat layer may range from about 0 to about 20%. When present in the thermally imageable layer, the thermal amplification additive weight percentage is generally at a level of about 0.95, to about 11.5%. When present in the intermediate layer, the thermal amplification additive weight percentage is generally at a level of about 0–20%. The percentage can range up to about 25% of the total weight percentage in the thermally imageable layer or overcoat layer. These percentages are non-limiting and one of ordinary skill in the art can vary them depending upon the particular composition of the ejection layer or colored layer.

The donor element may have additional layers. For example, an antihalation layer may be used on the side of the optional intermediate layer opposite the thermally imageable layer. Materials which can be used as antihalation agents are well known in the art. Other anchoring or subbing layers can be present on either side of the intermediate layer and are also well known in the art.

Other donor elements may comprise alternate thermally imageable layer or layers on a support. Additional layers may be present depending of the specific process used for imagewise exposure and transfer of the formed images. Some suitable thermally imageable layers over which the overcoat described above may be applied are disclosed in U.S. Pat. No. 5,773,188, U.S. Pat. No. 5,622,795, U.S. Pat. No. 5,593,808, U.S. Pat. No. 5,334,573, U.S. Pat. No. 5,156,938, U.S. Pat. No. 5,256,506, U.S. Pat. No. 5,427,847, U.S. Pat. No. 5,171,650 and U.S. Pat. No. 5,681,681.

Figure 2:
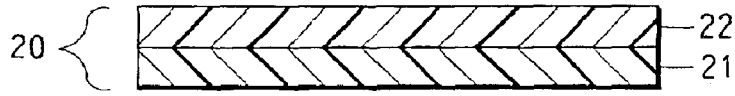
FIG. 2 is a simplified schematic diagram showing a cross-section of a receiver element.

The receiver element (20), shown in FIG. 2, is the second part of the laserable assemblage, to which the exposed areas of the thermally imageable layer, comprising binder and colorant, are transferred. In most cases,, the exposed areas of the thermally imageable layer will not be removed from the donor element in the absence of a receiver element. That is, exposure of the donor element alone to laser radiation does not cause material to be removed, or transferred. The exposed areas of the thermally imageable layer, are removed from the donor element only when it is exposed to laser radiation and the donor element is in contact with or adjacent to the receiver element. In the preferred embodiment, the donor element actually touches the receiver element.

The receiver element (20) may be non-photosensitive or photosensitive. The non-photosensitive receiver element preferably comprises a receiver support (21) and an image receiving layer (22). The receiver support (21) comprises a dimensionally stable sheet material. The assemblage can be imaged through the receiver support if that support is transparent. Examples of transparent films for receiver supports include, for example polyethylene terephthalate, polyether sulfone, a polyimide, a poly(vinyl alcohol-co-acetal), polyethylene, or a cellulose ester, such as cellulose acetate. Examples of opaque support materials include, for example, polyethylene terephthalate filled with a white pigment such as titanium dioxide, ivory paper, or synthetic paper, such as Tyvelk® spunbonded polyolefin. Paper supports are typical and are preferred for proofing applications, while a polyester support, such as poly(ethylene terephthalate) is typical and is preferred for a medical hardcopy and color filter array applications. Roughened supports may also be used in the receiver element.

The image-receiving layer (22) may be a coating of, for example, a polycarbonate; a polyurethane; a polyester; polyvinyl chloride; styrene/acrylonitrile copolymer; poly (caprolactone); vinylacetate copolymers with ethylene and/or vinyl chloride; (meth)acrylate homopolymers (such as butyl-methacrylate) and copolymers; polycaprolactone; polyesters; and mixtures thereof. Typically, the image receiving layer is a crystalline polymer layer, polyester or mixture thereof. The image receiving layer polymer preferably has a melting point in the range of 50 to 64° C., more preferably 56 to 64° C., and most preferably 58 to 62° C. Blends made from 5–40% Capa® 650 (melt range 58–60° C.) and Tone® P-300 (melt range 58–62° C.), both polycaprolactones, are useful in this invention. Typically, 100% Tone P-300 is used. Useful receiver elements are also disclosed in U.S. Pat. No. 5,534,387 issued on Jul. 9, 1996. One additional example is the WaterProof® Transfer Sheet sold by DuPont. Typically, it has an ethylene/vinyl acetate copolymer in the surface layer comprising more ethylene than the vinyl acetate.

This image-receiving layer may be present in any amount effective for the intended purpose. In general, good results have been obtained at coating weights of range of about 10 to about 150 mg/dm$^2$, typically about 40 to about 60 mg/m$^2$.

In addition to the image-receiving layer, the receiver element may optionally include one or more other layers (not shown) between the receiver support and the image receiving layer. An additional layer between the image-receiving layer and the support can be a release layer. The receiver support alone or the combination of receiver support and release layer may also be referred to as a first temporary carrier. The release layer can provide the desired adhesion balance to the receiver support so that the image-receiving layer adheres to the receiver support during exposure and separation from the donor element, but promotes the separation of the image receiving layer from the receiver support upon transfer, for example by lamination, of the image receiving layer to a permanent substrate or support. Examples of materials suitable for use as the release layer include polyamides, silicones, vinyl chloride polymers and copolymers, vinyl acetate polymers and copolymers and plasticized polyvinyl alcohols. The release layer can have a thickness in the range of 1 to 50 microns.

A cushion layer which is a deformable layer may also be present in the receiver element, typically between the release layer and the receiver support. The cushion layer may be present to increase the contact between the receiver element and the donor element when assembled. Examples of suitable materials for use as the cushion layer include copolymers of styrene and olefin monomers such as styrene/ethylene/butylene/styrene, styrene/butylene/styrene block copolymers, and other elastomers useful as binders in flexographic plate applications.

The receiver element is an intermediate element in the process of the invention because the laser imaging step is normally followed by one or more transfer steps by which the exposed areas of the thermally imageable layer are eventually transferred to the permanent substrate.

Figure 3:
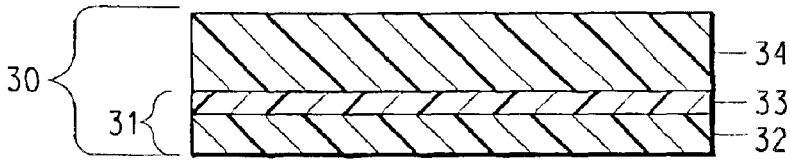
FIG. 3 is a simplified schematic diagram showing a cross-section of an image rigidification element.

The image rigidification element (30), shown in FIG. 3, comprises a releasable support (32) having a release surface (33), and a thermoplastic polymer layer (34).

The support having a release surface or second temporary carrier (31) may comprise a support (32) and a surface layer (33) which may be a release layer. If the material used as the support, has a release surface, e.g., polyethylene or a fluoropolymer, no additional surface layer is needed. The surface or release layer (33) should have sufficient adhesion to the support (32) to remain affixed to the support throughout the processing steps of the invention. Almost any material that has reasonable stiffness and dimensional stability is useful as the support. Some examples of useful supports include polymeric films such as polyesters, including polyethylene terephthalate and polyethylene naphthanate; polyamides; polycarbonates; fluoropolymers; polyacetals; polyolefms, etc. The support may also be a thin metal sheet or a natural of synthetic paper substrate. The support may be transparent, translucent or opaque. It may be colored and may have incorporated therein additives such as fillers to aid in the movement of the image rigidification element through the lamination device during its lamination to the color image containing receiver element.

The support may have antistatic layers coated on one or both sides. This may be useful in reducing static when the support is removed from the thermoplastic polymer layer during the process of the invention. It is generally preferred to have antistatic layers coated on the back side of the support, i.e., the side of the support away from the thermoplastic polymer layer. Materials which can be used as antistatic materials are well known in the art. Optionally, the support may also have a matte texture to aid in transport and handling of the image rigidification element.

The support typically has a thickness of about 20$\mu$ to about 250$\mu$. A preferred thickness is about 55 to 200$\mu$.

The release surface of the support may be provided by a surface layer (33). Release layers are generally very thin layers which promote the separation of layers. Materials useful as-release layers are well known in the art and include, for example, silicones; melamine acrylic resins; vinyl chloride polymers and copolymers; vinyl acetate polymers and copolymers; plasticized polyvinyl alcohols; ethylene and propylene polymers and copolymers; etc. When a separate release layer is coated onto the support, the layer generally has a thickness in the range of 0.5 to 10 micrometers.

The release layer (33) may also include materials such as antistats, colorants, antihalation dyes, optical brighteners, surfactants, plasticizers, coating aids, matting agents, and the like.

Thermoplastic polymers useful in the thermoplastic polymer layer are preferably amorphous, i.e., non-crystalline, in character, have high softening points, moderate to high molecular weight and compatibility with the components of the image receiving polymer layer, e.g., polycaprolactone. Additionally, flexibility without cracking and possessing the capability to be attached to many different permanent substrates is advantageous. The polymer is preferably solvent soluble, has good solvent and light stability and is a good film former.

There are many useful thermoplastic polymer materials. Preferred for use in this invention are thermoplastic polymers having Tgs (glass transition temperatures) in the range of about 27 to 150° C., preferably 40 to 70° C., and more preferably 45 to 55° C., a relatively high softening points, e.g., Tg of 47° C., melt flow of 142° C.), low elongations at break as determined by ASTM D822A of e.g., 3, and moderate weight average molecular weight (Mw), e.g., in the area of 67,000. Polyester polymers, e.g., having a Tg of about 47° C., are preferred because good compatibility is achieved between the image receiving polymer, e.g., crystalline polycaprolactone and the polyester polymer in the image rigidification layer. However, other suitable polymers have been shown to give acceptable results. Some suitable materials include methacrylate/acrylate, polyvinylacetate, polyvinylbutyral, polyvinylformal, styrene-isoprene-styrene and styrene-ethylene-butylene-styrene polymers, etc.

The thermoplastic polymer is present in the amount of about 60 to 90% by weight, typically about 70 to 85% by weight, based on the total weight of the thermoplastic polymer layer components.

The thermoplastic polymer layer and image receiving layer relate to each other in that the colored image is encased between them so that it does not move significantly during lamination to the permanent substrate, e.g., paper, and cooling. This significantly reduces halftone dot movement, swath boundary cracking and banding compared to similar processes not employing a thermoplastic polymer layer in this manner, i.e., an image rigidification element, and renders them barely perceptible or substantially eliminated.

The use of the thermoplastic polymer layer in the processes and products of this invention results in an increase in lamination throughput speeds from 200 nm/min to approximately 600–800 mm/min (3–4 fold increase) without the introduction of defects, and provides lamination process latitude to allow image transfer to many different types of permanent substrates.

The thermoplastic polymer layer also provides a vehicle or mechanism for the introduction of bleaching chemistry to reduce the impact on final color associated with the NIR dye in the transferred color image to the permanent substrate.

The thermoplastic polymer layer may also contain additives as long as they do not interfere with the functioning of this layer. For example, additives such as plasticizers, other modifying polymers, coating aids, surfactants can be used. Some useful plasticizers include polyethylene glycols, polypropylene glycols, phthalate esters, dibutyl phthalate and glycerine derivatives such triacetin. Typically, the plasticizer is present in the amount of about 1 to 20% by weight, most typically 5 to 15% by weight, based on the total weight of the thermoplastic polymer layer components.

As noted above, the thermoplastic polymer layer also preferably contains dye bleaching agents for bleaching the thermal amplification additive, such as an NIR dye, which may be present in the donor element and/or the receiver element. Some useful bleaching agents include amines; azo compounds; carbonyl compounds; hydantoin compounds selected from the dichlorodimethyl derivatives, dibromodimethyl derivatives and cholorobromodimethyl derivatives; organometallic compounds; and carbanions. Useful oxidants include peroxides, diacyl peroxides, peroxy acids, hydroperoxides, persulfates, and halogen compounds. Typical dye bleaching agents for polymethine type NIR dyes are those selected from the group consisting of hydrogen peroxide, organic peroxides, hydantoin compounds, hexaaryl biimidazoles, halogenated organic compounds, persulfates, perborates, perphosphates, hypochiorites and azo compounds.

Dye bleaching agents are present in the amount of about 1 to 20% by weight, typically about 5 to 15% by weight, based on the total weight of the thermoplastic polymer layer.

One advantage of the process of this invention is that the permanent substrate for receiving the colored image, can be chosen from almost any sheet material desired. For most proofing applications a paper support is used, preferably the same paper on which the image will ultimately be printed. Any paper stock can be used. Other materials which can be used as the permanent substrate include cloth, wood, glass, china, most polymeric films, synthetic papers, thin metal sheets or foils, etc. Almost any material which will adhere to the thermoplastic polymer layer (34), can be used as the permanent substrate.

Process Steps

Figure 4:
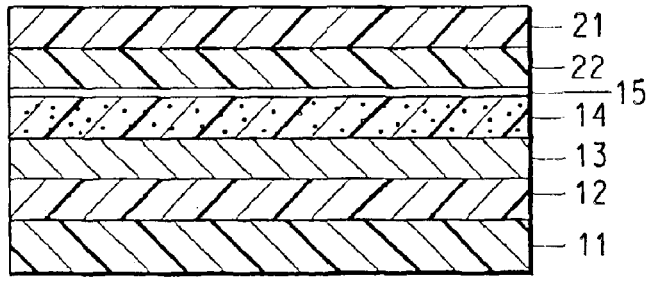
FIGS. 4 to 8 are a simplified schematic diagrams showing in cross-section the subsequent processing steps employing the donor element, the receiver element and the image rigidification element, and the final product obtained.

Exposure:

The first step in the process of the invention is imagewise exposing the laserable assemblage, e.g., as shown in FIG. 4, to laser radiation. The exposure step is preferably effected at a laser fluence of about 600 mJ/cm$^2$ or less, most preferably about 250 to 440 mJ/cm$^2$. The laserable assemblage comprises the donor element and the receiver element, described above.

The assemblage is normally prepared following removal of coversheet(s), if present, by placing the donor element in contact with the receiver element such that overcoat layer actually touches the image-receiving layer on the receiver element. This is represented in FIG. 4. Vacuum and/or pressure can be used to hold the two elements together. Alternately, the donor and receiver elements may be spaced slightly apart using spacer particles in the overcoat layer or the image receiving layer. As one alternative, the donor and receiver elements can be held together by fusion of layers at the periphery. As another alternative, the donor and receiver elements can be taped together and taped to the imaging apparatus, or a pin/clamping system can be used. As yet another alternative, the donor element can be laminated to the receiver element to afford a laserable assemblage. The laserable assemblage can be conveniently mounted on a drum to facilitate laser imaging.

Various types of lasers can be used to expose the laserable assemblage. The laser is preferably one, emitting in the infrared, near-infrared or visible region. Particularly advantageous are diode lasers emitting in the region of about 750 to 870 nm which offer a substantial advantage in terms of their small size, low cost, stability, reliability, ruggedness and ease of modulation. Diode lasers emitting in the range of about 780 to 850 nm are most preferred. Such lasers are available from, for example, Spectra Diode Laboratories (San Jose, Calif.).

The exposure can take place though the flexible ejection layer or subbing layer of the donor element or through the receiver element, provided that these are substantially transparent to the laser radiation. In most cases, the donor flexible ejection layer or subbing layer will be a film which is transparent to infrared radiation and the exposure is conveniently carried out through the flexible ejection or subbing layer. However, if the receiver element is substantially transparent to infrared radiation, the process of the invention can also be carried out by imagewise exposing the receiver element to infrared laser radiation.

The laserable assemblage is exposed imagewise so that the exposed areas of the thermally imageable layer are transferred to the receiver element in a pattern. The pattern itself can be, for example, in the form of dots or line work generated by a computer, in a form obtained by scanning artwork to be copied, in the form of a digitized image taken from original artwork, or a combination of any of these forms which can be electronically combined on a computer prior to laser exposure. The laser beam and the laserable assemblage are in constant motion with respect to each other, such that each minute area of the assemblage, i.e., "pixel" is individually addressed by the laser. This is generally accomplished by mounting the laserable assemblage on a rotatable drum. A flat bed recorder can also be used.

The next step in the process of the invention is separating the donor element from the receiver element. Usually this is done by simply peeling the two elements apart. This generally requires very little peel force, and is accomplished by simply separating the donor support from the receiver element. This can be done using any conventional separation technique and can be manual or automatic without operator intervention.

Figure 5:
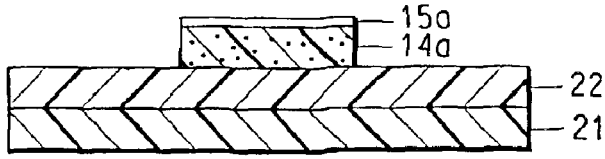

As shown in FIG. 5, separation results in a laser generated color image preferably a halftone dot image, comprising the transferred exposed areas of the thermally imageable layer and overcoat layer, being revealed on the image receiving layer of the receiver element. Preferably the color image formed by the exposure and separation steps is a laser generated halftone dot color image formed on a crystalline polymer containing layer, the crystalline polymer containing layer being located on a first temporary carrier.

Figure 6:
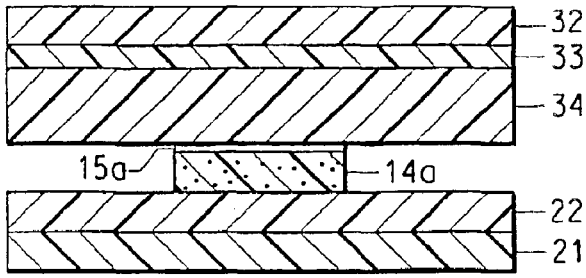

The image rigidification element is then brought into contact with, preferably laminated to, the image receiver element with the color image in contact with the thermoplastic polymer layer of the image rigidification element resulting in the thermoplastic polymer layer of the rigidification element and the image receiving layer of the receiver element encasing the color image. This is best seen in FIG. 6. A WaterProof® Laminator, manufactured by DuPont is preferably used to accomplish the lamination. However, other conventional means may be used to accomplish contact of the image carrying receiver element with the thermoplastic polymer layer of the rigidification element. It is important that the adhesion of the rigidfication element support having a release surface (31), also known as the second temporary carrier, to the thermoplastic polymer layer (34) be less than the adhesion between any other layers in the sandwich. The novel assemblage or sandwich, e.g., as illustrated by FIG. 6, is highly useful, e.g., as an improved image proofing system.

Figure 6A:
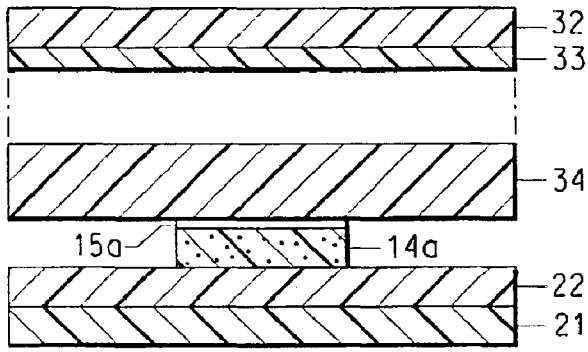

The support (32) having a release surface (33) (or second temporary carrier) is then removed, preferably by peeling off, to reveal the thermoplastic film as seen in FIG. 6*a*. The color image on the receiver element is then transferred to the permanent substrate by contacting the permanent substrate with, preferably laminating it to, the revealed thermoplastic polymer layer of the sandwich structure shown in FIG. 6*a*. Again a WaterProof® Laminator, manufactured by DuPont, is preferably used to accomplish the lamination. However, other conventional means may be used to accomplish this contact which results in the sandwich structure shown in FIG. 7.

Figure 7:
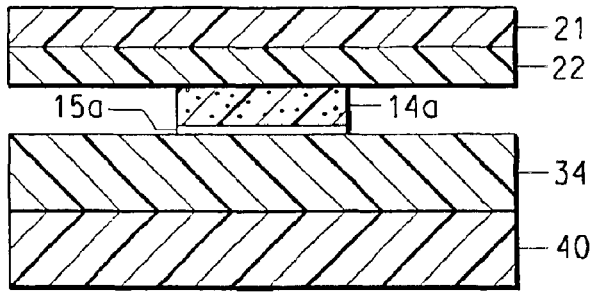
Figure 8:
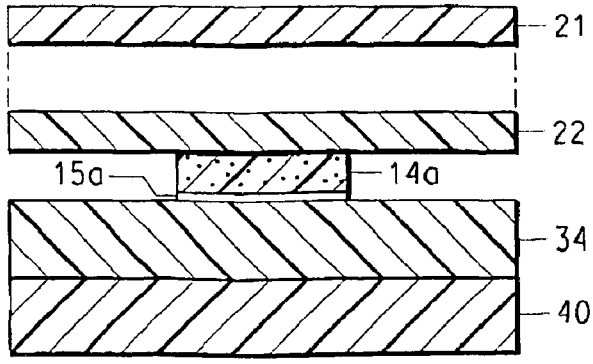

Another embodiment includes the additional step of removing, preferably by peeling off, the receiver support (21) (also known as the first temporary carrier), resulting in the assemblage or sandwich structure shown in FIG. 8. In a preferred embodiment, the assemblages illustrated in FIGS. 7 and 8 represent a printing proof comprising a laser generated halftone dot color thermal image formed on an image receiving layer, and a thermoplastic polymer layer laminated on one surface to said image receiving layer and laminated on the other surface to the permanent substrate, whereby the color image is encased between the image receiving layer and the thermoplastic polymer layer.

In proofing applications, the receiver element can be an intermediate element onto which a multicolor image is built up. Some or all of the donor elements in this embodiment do not require an overcoat layer for making multicolor images. An overcoated donor element having a thermally imageable layer comprising a first colorant and an overcoat layer thereon is exposed and separated as described above. The receiver element has a color image formed with the first colorant, which is preferably a laser generated halftone dot color thermal image. Thereafter, a second overcoated donor element having a thermally imageable coating different than that of the first overcoated thermally imageable element forms a laserable assemblage with the receiver element having the colored image of the first colorant and is image-wise exposed and separated as described above. The steps of (a) forming the laserable assemblage with a donor element having a different colorant than that used before and the previously imaged receiver element, (b) exposing, and (c) separating are sequentially repeated as often as necessary in order to build the multicolored image of a color proof on the receiver element.

The rigidification element is then brought into contact with, preferably laminated to, the multiple colored images on the image receiving element with the last colored image in contact with the thermoplastic polymer layer. The process is then completed as described above.

EXAMPLES

These non-limiting examples demonstrate the processes and products claimed and described herein. All temperatures throughout the specification are in ° C. (degrees Centigrade) and all percentages are weight percentages unless indicated otherwise.

The following black solution was made and coated to 12–14 mg/sq dm using a #6 wire round rod onto 50% T Chrome (that is a chromium coating) on 4 mil Melinex® 562 (DuPont):

TABLE 1

| Ingredients | % Solids | % Dispersant | % Pigment | Black Donor Solution (100 g sol'n) |
|---|---|---|---|---|
| Distilled Water | 0 | 0 | 0 | 67.6 |
| Polymer 1[1] | 37.4 | 100 | 0 | 23.4 |
| Binder 1[2] | 47 | 100 | 0 | 3.47 |
| Penn Color 32B56[3] | 44.2 | 12.2 | 32 | 4.83 |
| PEG 300[4] | 100 | 100 | 0 | 0.521 |
| Zonyl ® FSA (25% FC)[5] | 100 | 100 | 0 | 0.162 |
| Total | | | | 100 |

[1]is an acrylic latex copolymer of 74% methyl methacrylate and 24% butyl methacrylate
[2]is a latex (47% solids) comprising a mixture of butyl acrylate/acrylonitrile/methacrylic acid copolymer (60/35/5)
[3]is manufactured by Penn Color, PA.
[4]is polyethylene glycol, MW 300
[5]is a fluorocarbon surfactant The following solutions were made of Carboset® GA-33 (aqueous acrylic polymer dispersion made by B. F. Goodrich) at 5% solids and Zinpol® 20 (aqueous polyethylene wax emulsion made by B. F. Goodrich possessing a melt point of 138° C.) at 5% solids and then blended to make overcoat solutions. The overcoat solutions were coated using a #4 wire rod to 2 mg/sq dm on top of the black film and dried. Below are the solutions and blends that were made and tested:

TABLE 2

| Ingredients | % Solids | Acrylic (GA-33) Solution |
|---|---|---|
| Distilled Water | | 260 |
| Acrylic (GA-33) | 37.5 | 40 |
| Total | | 300 |
| % Solids | | 5 |

TABLE 2-continued

| Ingredients | % Solids | Wax (Zinpol ® 20) Solution |
|---|---|---|
| Distilled Water | | 257.14 |
| Wax (Zinpol ® 20) | 35 | 42.86 |
| Total | | 300 |
| % Solids | | 5 |
| Blended Overcoat Solutions | | |
| 100% Wax (Zinpol ® 20) | | |
| 30/70 Acrylic (GA-33)/Wax (Zinpol ® 20) | | |
| 50/50 Acrylic (GA-33)/Wax (Zinpol ® 20) | | |
| 70/30 Acrylic (GA-33)/Wax (Zinpol ® 20) | | |

Coated films tested were:

Film #1—Black Control—no overcoat

Film #2—100% Wax (Zinpol 20) overcoated on black

Film #3—30/70 Acrylic (GA-33)/Wax (Zinpol 20) overcoated on black

Film #4—50/50 Acrylic (GA-33)/Wax (Zinpol 20) overcoated on black

Film #5—70/30 Acrylic (GA-33)/Wax (Zinpol 20) overcoated on black

For the durability evaluation, each film was placed on a solid surface with the coating face up. A 6-inch stroke applied to the Film #1 coating with either a fingernail or a No. 2 pencil caused deep scratches to form, removing the coating entirely, thus damaging the coating surface. The same test applied to Films #2–#5 produced no damage to the coating surface.

The following receiver element and image rigidification elements were used in making a color image:

Receiver Element 1:

A receiver element, comprised of 100% Tone P-300 (Polycaprolactone, crystalline polymer, melt range 58–62° C., Union Carbide) was made by coating a 15% solids solution in tetrahydrofuran (THF) to a dried thickness of 53 mg/dm$^2$ on 300 gauge EB-11Mylar) polyester film, as a receiver support (or first temporary carrier) having a release surface (sold by DuPont). The dried coating thickness was 50–55 mg/dm$^2$ and comprised the image receiving layer.

Image Rigidification Element 1:

An image rigidification layer incorporating a plasticizer and an NIR dye bleaching agent was made by coating the following composition from a 20% solids solution, with a #10 wire wound rod on slip treated Melinex® 377 polyester film, as the support having a release surface, and dried thickness of 55 mg/dm$^2$.

TABLE 3

| Ingredient | % solids |
|---|---|
| 2-Butanone (solvent) | |
| Dibutyl Phthalate (plasticizer) | 5 |
| Dicyclohexylphthalate (plasticizer) | 8 |
| 1,3-dichloro-5,5-dimethyl hydantoin (NIR dye bleaching agent) | 5 |
| Vitel ® 2700B (thermoplastic polymer) | 82 |

Process:

Each of the above identified black films #1–5 was placed in the cassette of a Creo Spectrum Trendsetter and imaged to receiver element #1 at 12.5 watts, 170 rpm. The image formed was laminated to the image rigidification layer, of image rigidification element 1. After peeling of the receiver support, the sandwich was then laminated to a final permanent substrate, (Lustro Gloss #100 paper).

Laminations were done with the standard WaterProof® laminator (DuPont) using the paper setting (120° C. top roll, 115° C. bottom roll; 450#; 600 nm/min). After allowing the sandwich to cool (about 2 minutes), the receiver support (first temporary carrier) was removed leaving behind a black halftone dot thermal image on paper. Results with all 5 films, indicated that the image quality of the halftone dot images were the same. Where coating surfaces had been damaged with Film #1, the halftone image could not be produced. This demonstrates that relative to the control Film #1, the overcoated films prevent handling damage and do not adversely affect image quality.

Four color images may be prepared by repeating the above steps using the receiver having the black image thereon and magenta, cyan, and yellow films, respectively in the imaging step instead of the black film, and then repeating the following steps to get a four color image on paper.

What is claimed is:

1. A method for making an image comprising imagewise exposing to laser radiation a laserable assemblage comprising:

(A) a donor element comprising (a) a thermally imageable layer having a coatable surface; and (b) an overcoat layer on the coatable surface of the thermally imageable layer, the overcoat layer comprising a wax having a melting point in the range of 30° C. to 350° C.; and (B) a receiver element in contact with the overcoat layer of the donor element;

whereby the exposed areas of the thermally imageable layer and overcoat layer are transferred to the receiver element to form an image.

2. The method of claim 1 wherein the wax is carnauba wax, paraffin wax, montan wax or microcrystalline wax.

3. The method of claim 1 wherein the wax is selected from the group consisting of a Fischer-Tropsch wax, polyolefin glycol, high density polyethylene, low density polyethylene, polyethyleneacrylic acid, polypropylene, oxidized high density polyethylene, and combinations thereof.

4. The method of claim 1 wherein the overcoat layer further comprises an acrylic polymer.

5. The method of claim 1 wherein the overcoat layer further comprises an IR absorber.

6. The method of claim 1 in which the wax is selected from the group consisting of a natural vegetable wax, a mineral wax or a synthetic wax.

7. The method of claim 6 in which the natural vegetable wax has a melting point in the range of about 80° C. to about 88° C., the mineral wax has a melting point in the range of about 45° C. to about 100° C., and the synthetic wax has a melting point in the range of about 30° C. to about 350° C.

8. The method of claim 1 wherein the receiver element comprises (a) an image receiving layer in contact with the overcoat layer of the donor element, and (b) a receiver support for the image receiving layer;

whereby the exposed areas of the thermally imageable layer and overcoat layer form the image on the image receiving layer.

9. The method of claim 8 further comprising the step of separating the donor element (A) from the receiver element (B), thereby revealing the image on the image receiving layer of the receiving element.

10. The method of claim 9 further comprising after the separating step, contacting the receiver element with a permanent substrate, with the image receiving layer bearing the revealed image adjacent the permanent substrate, to transfer the revealed image to the permanent substrate.

11. The method of claim 10 wherein the permanent substrate is paper.

12. The method of claim 9 further comprising after the separating step:

contacting the image on the image receiving layer of the receiver clement with an image rigidification element comprising:

(a) a support having a release surface, and (b) a thermoplastic polymer layer, the image being adjacent the thermoplastic polymer layer during said contacting, whereby the image is encased between the thermoplastic polymer layer and the image receiving layer of the receiving element;

removing the support having a release surface thereby revealing the thermoplastic polymer layer; and contacting the revealed thermoplastic layer with permanent substrate.

13. The method of claim 12 further comprising the step of removing the receiver support.

14. The method of claim 12 wherein the donor element is formed by applying the thermally imageable layer comprising a colorant to a base element, followed by application of the overcoat layer.

15. The method of claim 14 wherein the base element comprises a support and a heating layer.

16. A method for making an image comprising imagewise exposing to laser radiation a laserable assemblage comprising:

(A) a donor element comprising (c) a thermally imageable layer having a coatable surface; and (d) an overcoat layer on the coatable surface of the thermally imageable layer, the overcoat layer comprising a wax having a melting point in the range of 30° C. to 350° C., and selected from the group consisting of polyolefin glycol, high density polyethylene, low density polyethylene, polyethyleneacrylic acid, polypropylene, oxidized high density polyethylene, and combinations thereof; and (B) a receiver element in contact with the overcoat layer of the donor element;

whereby the exposed areas of the thermally imageable layer and overcoat layer are transferred to the receiver element to form an image.

* * * * *